United States Patent [19]

Zimmerman

[11] 4,438,933

[45] Mar. 27, 1984

[54] HYDRAULIC SET HIGH TEMPERATURE ISOLATION PACKER

[75] Inventor: John C. Zimmerman, Duncan, Okla.

[73] Assignee: Halliburton Company, Duncan, Okla.

[21] Appl. No.: 375,418

[22] Filed: May 6, 1982

[51] Int. Cl.[3] ..... E21B 43/04

[52] U.S. Cl. ..... 277/9.5; 277/116; 166/278

[58] Field of Search ..... 277/9.5, 27, 116; 166/278, 51

[56] References Cited

U.S. PATENT DOCUMENTS 2,138,569 11/1938 Brown ..... 277/9.5

2,695,068 11/1954 Baker et al. ..... 277/9.5

4,273,190 6/1981 Baker et al. .

*Primary Examiner*—Robert T. Smith

*Attorney, Agent, or Firm*—Joseph A. Walkowski; Thomas R. Weaver

[57] ABSTRACT

The invention comprises a packer design for use in high temperature well bores. The packer is set by pressuring the well fluid through a tubing string, which moves a piston and shoe assembly on the packer mandrel, compressing a non-elastomeric high temperature packer element. The piston and shoe assembly combination is maintained in position after pressure is decreased, and the packer element is maintained in a compressed state by belleville springs which compensate for the lack of resiliency of the non-elastomeric packer element.

18 Claims, 4 Drawing Figures

HYDRAULIC SET HIGH TEMPERATURE ISOLATION PACKER

BACKGROUND OF THE INVENTION

The invention relates to high temperature packers for use in well bores. During a multiple-zone gravel packing operation, it is common practice to run a liner string into a cased hole in order to isolate the various zones from one another through use of packers placed between the zones. Such a gravel packing operation and the apparatus therefor is described in U.S. Pat. No. 4,273,190 to E. E. Baker et al, assigned to Halliburton Company and incorporated herein by reference. Inflatable packers, such as are disclosed in the aforesaid patent, are usually employed to isolate the zones. However, in certain geological formations, particularly as petroleum wells are drilled to even greater depths, the temperatures exceed those below which an inflatable packer may be employed. This is due to the inability of an inflatable packer employing an elastomeric bladder to withstand temperatures without leakage past the packer or breakdown of the elastomeric packer components. Similarly, a compression-type elastomeric element packer will not function as the elements will fail under high temperatures. Furthermore, as steam injection becomes more prevalent for enhanced recovery operations, elastomers will not perform adequately under the temperatures generated in the injection process. The use of non-elastomeric packer elements in known packers presents a problem in maintaining the seal of the packer, as the non-elastomeric elements, with their lack of inherent elasticity or "spring," will tend to relax and unseal if a constant force is not exerted against them. A packer using trapped fluid under pressure might suffice to exert such a force if the desired packer seal is to be temporary, but for a permanent installation at high temperatures fluid seals cannot be relied upon.

SUMMARY OF THE INVENTION

The present invention comprises a packer design capable of operating in a high temperature environment. The packer element is non-elastomeric, being fabricated of asbestos fiber impregnated with an intermediate hard thermoplastic element such as polytetrafluoroethylene (Teflon), interwoven with Inconel wire. The packer element is compressed hydraulically, through the action of a piston and shoe assembly on the packer mandrel against the packer element. Retraction of the piston and shoe assembly is mechanically prevented even after hydraulic pressure is reduced, and compression of the non-resilient packer element is maintained through the use of belleville springs which are incorporated in the piston and shoe assembly combination.

Thus, there is described a simple and reliable design for a high temperature packer with none of the drawbacks and limitations inherent in the prior art.

BRIEF DESCRIPTION OF THE DRAWINGS

The high temperature packer of the present invention will be more easily understood with reference to the detailed description of the preferred embodiments set forth hereafter, taken in conjunction with the accompanying drawings, wherein.

DETAILED DESCRIPTION AND OPERATION OF A FIRST PREFERRED EMBODIMENT

Figure 1:
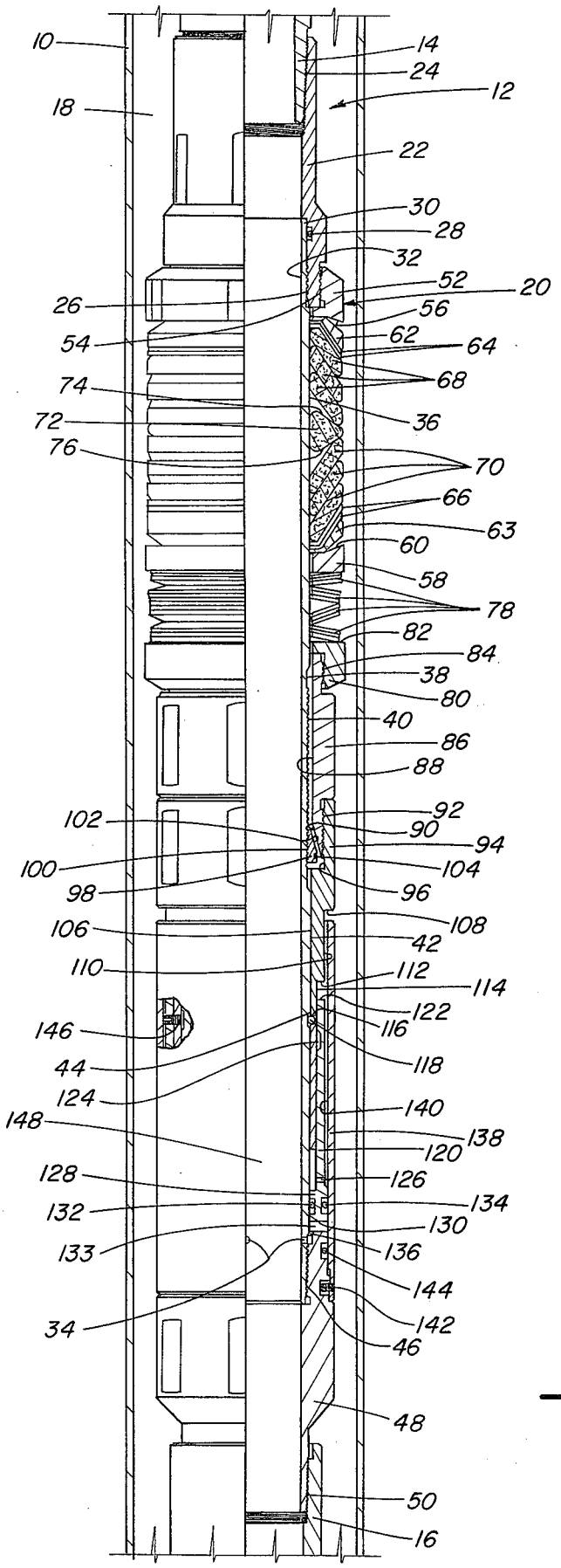
FIG. 1 illustrates a vertical half-sectional elevation of a first preferred embodiment of the high temperature packer of the present invention, suspended in a well bore casing as part of a liner assembly.
Figure 2:
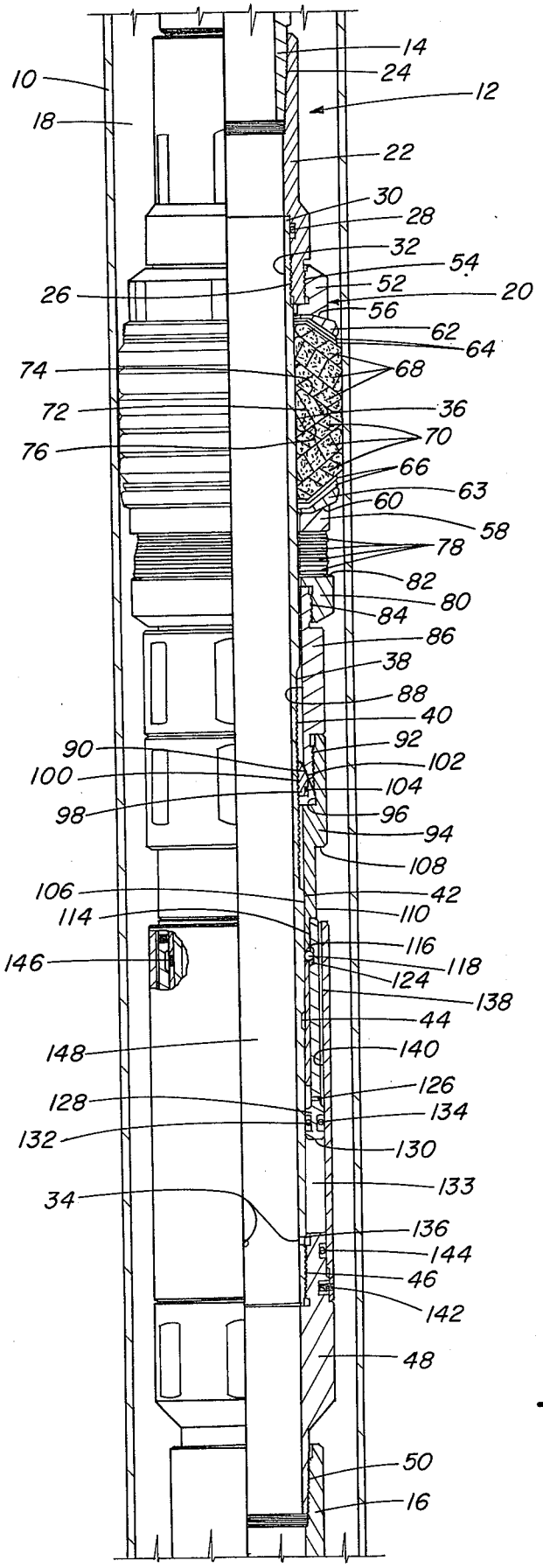
FIG. 2 depicts the high temperature packer of FIG. 1 after it has been set in the well bore casing.

Referring to FIGS. 1 and 2 of the drawings, a first preferred embodiment of the packer of the present invention will be described hereafter. Casing 10 surrounds high temperature packer 20, which is suspended therein as a part of liner assembly 12. Liner assembly 12 may include other packers such as packer 20, as well as gravel collars and other tools associated with gravel packing, such as are known in the art and disclosed in the previously referenced U.S. Pat. No. 4,273,190. However, immediately above and below packer 20 are placed sections of liner pipe 14 and 16 respectively.

Packer 20 is attached to liner pipe 14 at connector 22 by threaded connection 24. Connector 22 surrounds the upper end of packer mandrel 30, and is threaded thereto at 26, a seal being effected therebetween at 28 by an O-ring backed at either side by backup seals. Packer mandrel 30 possesses an inner bore wall 32 of substantially uniform diameter throughout its axial extent. Bore wall 32 is pierced near its lower extent by a plurality of radially spaced packer actuation ports 34, the purpose of which will be explained hereafter with respect to the operation of packer 20.

Below threaded connection 26, the exterior of packer mandrel 30 is of a substantially uniform diameter 36. Below diameter 36, there is a short area of reduced diameter 38 which is followed by an extended area of axially upward-facing ratchet teeth 40. Below ratchet teeth 40, the exterior of mandrel 30 increases to diameter 42, which possesses therein an annular groove 44 having beveled axially leading and trailing side walls. Packer mandrel 30, adjacent packer actuation port 34, is threaded at 46 to nipple 48, which in turn is threaded at 50 to blank liner pipe 16.

Referring again to the upper end of packer 20, upper anchor shoe 52 is threaded to the exterior of connector 22 at 54. Upper anchor shoe 52 possesses a radially outward-extending lower face 56, the outer extent of which extends slightly downward. Below and facing upper packer shoe 52 is lower sliding shoe 58, which possesses a radially outward-extending upper face 60, the outer extent of which extends slightly upward. Lower sliding shoe 58 is slidably disposed on packer mandrel 30. Abutting upper anchor and lower sliding shoes 52 and 58, respectively, are upper and lower back-up shoes 62 and 63, respectively. Upper back-up shoe 62 faces downward, while lower back-up shoe 63 faces upward. Abutting upper back-up shoe 62 is a pair of nested radially slotted supports, or cups 64. The radial slots of each cup 64 are misaligned with those of the adjacent cup. In a similar manner, a pair of nested radially slotted supports or cups 66 abuts lower back-up shoe 63, the radial slots in the nested cups 66 being misaligned.

Packer segments are disposed about packer mandrel 30 between downward-facing cups 64 and upward-facing cups 66. The packer segments may be made of asbestos fiber impregnated with an intermediate hard thermoplastic such as Teflon, interwoven with Inconel wire. The resulting fabric is laid up in a preform, and subsequently pressure molded to form the desired segment shape. Center packer ring 72 is of a substantially triangular cross-section, having side faces 74 and 76 at convergently radially inclined equal angles to the radial extent of the packer ring. Between center packer ring 72 and upper cups 64 are a plurality of substantially identical downwardfacing frustoconical packer rings 68. Similarly, between packer ring 72 and lower cups 66 are located a plurality of upward-facing frustoconical packer rings 70. Rings 68 and 70 are of substantially the same outer diameter in their uncompressed state as cups 64 and 66, and rings 68 and 70 all have substantially parallel radially inclined side faces. The initial angle of radial inclination of the side faces of packer rings 68 and 70 is greater than that of side faces 74 and 76 of center packer ring 72. The packer element thus comprises packer segments 68, 70 and 72.

Below and abutting lower sliding shoe 58, and surrounding packer mandrel 30, are a plurality of belleville springs 78. Below belleville springs 78 is lower anchor shoe 80, having radially flat upper face 82. Lower anchor shoe 80 is threaded at 84 to latch nipple 86, which possesses an inner diameter substantially greater than the outer radial extent of ratchet teeth 40, which it surrounds. At the lower axial extent of latch nipple 86 is located downwardly radially divergent face 90. Latch nipple 86 is threaded to ball housing 94 at 92. Ball housing 94 possesses an undercut at 96. An annular cavity of substantially triangular cross-section is created by undercut 96, radially divergent face 90, and ratchet teeth 40. In the aforesaid annular cavity is disposed latching dog 98, which comprises a plurality of arcuate segments. The inner edge of these arcuate segments possesses downward-facing ratchet teeth 100 which mate with upward-facing ratchet teeth 40 on packer mandrel 30. The forward faces 102 of the segments of latching dog 98 are radially inclined at substantially the same angle as radially divergent face 90 of latch nipple 86. The segments of latching dog 98 are held against ratchet teeth 40 of packer mandrel 30 by O-ring 104. The lower face (unnumbered) of latching dog 98 is radially flat.

The inner wall 106 of ball housing 94 slides on the exterior 42 of packer mandrel 30. Ball housing 94 also possesses radially flat downward-facing annular surface 108 on its exterior. Surface 108 leads to surface 110 of reduced diameter, below which is a second downward-facing annular surface 112 leading to surface 114 of further reduced diameter. A plurality of apertures 116 are radially spaced about ball housing 94, communicating between surface 114 and inner wall 106. Balls 118, of greater diameter than the thickness of ball housing 94 at apertures 116, are placed in each of said apertures 116.

Annular piston 120 is slidably disposed about packer mandrel 30, the forward extent thereof riding on surface 114 of ball housing 94. The leading edge 122 of piston 120 is radially flat, and the forward extent of piston 120 has undercut therein an annular groove 124. A plurality of pressure relief ports 126 extend from the inner surface to the outer surface of the forward extent of piston 120. The trailing portion 128 of piston 120 is of greater wall thickness and smaller inner diameter than the forward extent thereof, riding in sealing engagement with surface 42 of packer mandrel 30 and also with outer sleeve 138, which surrounds piston 120 and a portion of ball housing 94. A seal is effected with packer mandrel 30 by O-ring and back-up seals 132, and with outer sleeve 138 by O-ring and back-up seals 134. The trailing surface 130 of piston 120 is radially flat.

Fluid passages 136 extend between an annular chamber defined by trailing surface 130, the inner surface 140 of outer sleeve 138, packer mandrel 30, the leading surface of nipple 48, and packer actuation ports 34.

A seal is effected between nipple 48 and outer sleeve 138 by O-ring and back-up seals 144, outer sleeve 138 being fixed to nipple 48 by set screws 142.

It should be noted that a plurality of shear pins 146 are radially interspersed with balls 118. Shear pins 146 secure piston 120 to ball housing 94 when packer 20 is being run into the well.

In operation packer 20 is run into the well casing 10 as a part of liner assembly 12. Liner assembly 12 is secured in place in the casing by means well known in the art. An isolation gravel packer such as is disclosed in U.S. Pat. No. 4,273,190 is placed across ports 34, and tubing pressure is applied therethrough against trailing surface 130 of annular piston 120. As annular piston 120 moves axially upward, shear pins 146, holding piston 120 and ball housing 96 together, shear and leading edge 122 of annular piston 120 moves upward to contact downwardfacing radially flat annular surface 108 of ball housing 94. The movement of annular piston 120 aligns annular groove 124 with balls 118, permitting them to move radially outward, thereby releasing ball housing 94 from its axially secured state (with balls 118 in groove 44).

Ball housing and latch nipple 86 then move axially upward, with lower anchor shoe, belleville springs 78 and lower sliding shoe 58, to compress the packer elements 68, 70 and 72 against upper packer shoe 52, forcing an increase in the diameter of the packer segments and in consequence a seal against casing 10 (see FIG. 2).

The movement of annular piston 120, ball housing 94 and latch nipple 86 in an axially upward direction carries latching dogs 98 in the same direction, due to contact of latching dogs 98 by the radially flat surface immediately below undercut 90 on ball housing 94. The downward-facing ratchet teeth 100 on latching dogs 98 ride over the upward-facing ratchet teeth 40 on packer mandrel 30 with minimal resistance.

At this point, packer segments 68, 70 and 72 are compressed, as are belleville springs 78. When tubing pressure is released, latch nipple 86 will tend to ride back down to its initial position due principally to the force exerted by the compressed belleville springs 78. This downward movement will be halted after a very brief travel by the contact of radially divergent face 90 with the forward faces 102 of latching dogs 98, which will force dogs 98 radially inward, locking them against mandrel 30 by the interaction of ratchet teeth 100 with ratchet teeth 40. Thus, the packer 20 is locked in a set position without the continued maintenance of tubing pressure, and packer segments 68, 70 and 72, which are of non-elastomeric materials, are maintained in compression by the continued force of compressed belleville springs 78.

DETAILED DESCRIPTION AND OPERATION OF A SECOND PREFERRED EMBODIMENT

Figure 3:
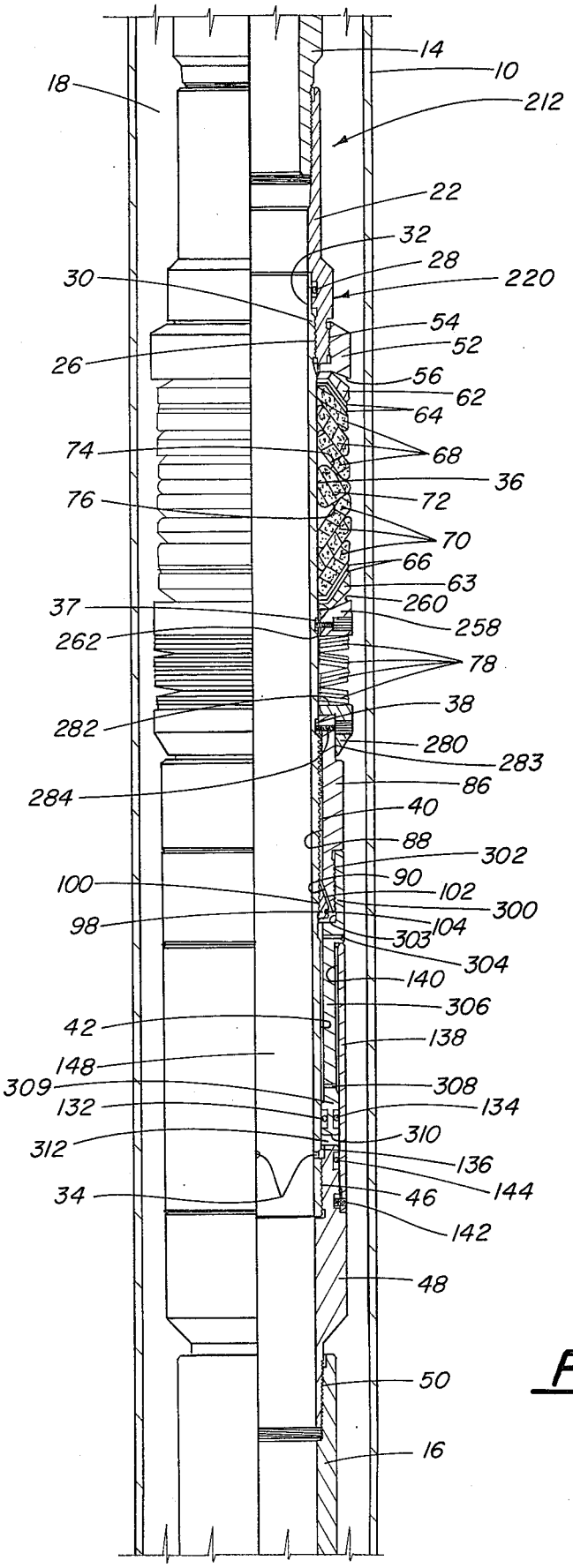
FIG. 3 illustrates a vertical half-sectional elevation of a second and most preferred embodiment of the high temperature packer of the present invention, suspended in a well bore as part of a liner assembly.
Figure 4:
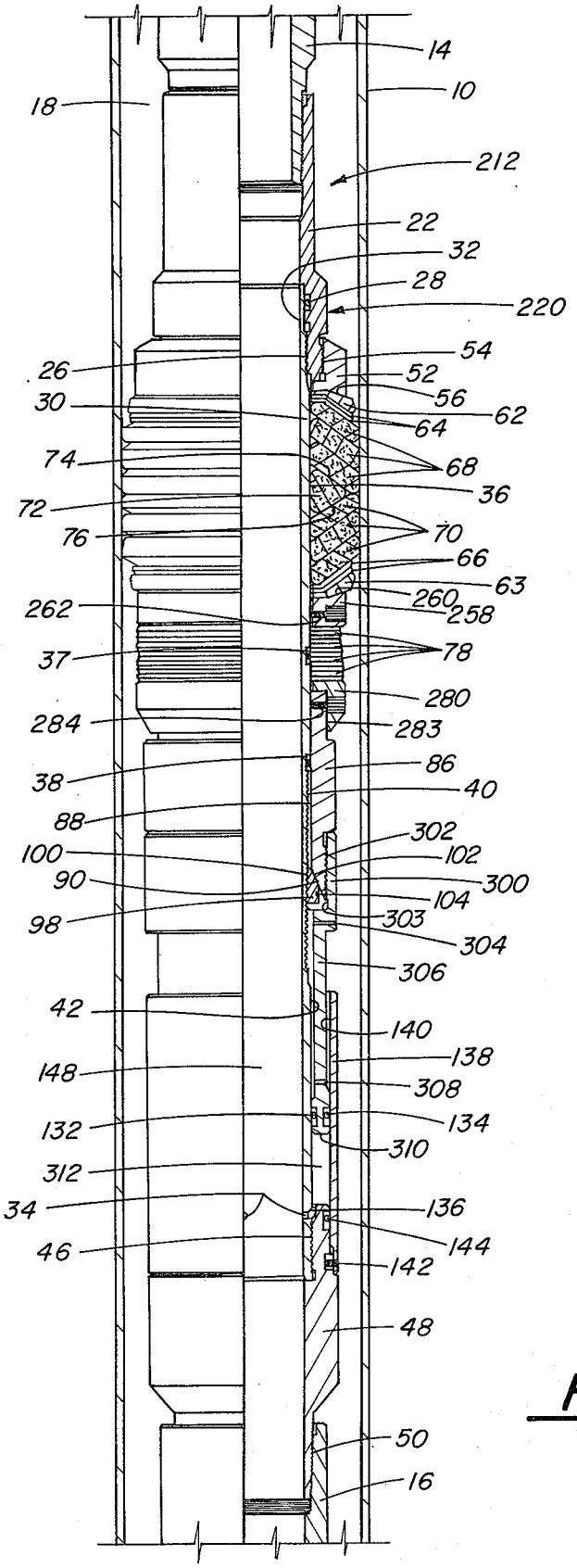
FIG. 4 depicts the high temperature packer of FIG. 3 after it has been set in the well bore casing.

Referring to FIGS. 3 and 4 of the drawings, a second and most preferred embodiment of the packer of the present invention will be described hereafter. Casing 10 surrounds high temperature packer 220, which is suspended therein as a part of liner assembly 212. Liner assembly 212 may include other packers such as packer 220, as well as gravel collars and other tools associated with gravel packing, such as are known in the art and disclosed in the previously referenced and incorporated U.S. Pat. No. 4,273,190. However, immediately above and below packer 220 are placed sections of liner pipe 14 and 16 respectively. Parts of packer 220 which are substantially identical to those of packer 20 have been identified by the same reference numerals as were employed in the detailed description of packer 20.

Packer 220 is attached to liner pipe 14 at connector 22 by threaded connection 24. Connector 22 surrounds the upper end of packer mandrel 30, and is threaded thereto at 26, a seal being effected therebetween at 28 by an O-ring backed at either side by backup seals. Packer mandrel 30 possesses an inner bore wall 32 of substantially uniform diameter throughout its axial extent. Bore wall 32 is pierced near its lower extent by radially spaced packer actuation ports 34, the purpose of which will be explained hereafter with respect to the operation of packer 20.

Below threaded connection 26, the exterior of packer mandrel 30 is of a substantially uniform diameter 36 having an annular recess 37 cut therein. Below diameter 36, there is a short area of reduced diameter 38 which is followed by an extended area of axially upward-facing ratchet teeth 40. Below ratchet teeth 40, the exterior of mandrel 30 increases to diameter 42. Packer mandrel 30, adjacent packer actuation port 34, is threaded at 46 to nipple 48, which in turn is threaded at 50 to blank liner pipe 16.

Referring again to the upper end of packer 220, upper anchor shoe 52 is threaded to the exterior of connector 22 at 54. Upper packer shoe 52 possesses a radially outward-extending lower face 56, the outer extent of which extends slightly downward. Below and facing upper packer shoe 52 is lower sliding shoe 258, which possesses a radially outward-extending upper face 260, the outer extent of which extends slightly upward. Lower sliding shoe 258 is slidably disposed on packer mandrel 30, but is held in the position shown in FIG. 3 as the packer 220 is run in the well by a plurality of radially spaced shear pins 262, the inner end thereof being received in annular recess 37. Abutting upper anchor and lower sliding shoes 52 and 58, respectively, are upper and lower back-up shoes 62 and 63, respectively. Upper back-up shoe 62 faces downward, while lower back-up shoe 63 faces upward. Abutting upper back-up shoe 62 is a pair of nested radially slotted supports, or cups 64. The radial slots of each cup 64 are misaligned with those of the adjacent cup 64. In a similar manner, a pair of nested radially slotted supports or cups 66 abuts lower back-up shoe 63, the radial slots in the nested cups 66 being misaligned.

Packer segments are disposed about packer mandrel 30 between downward-facing cups 64 and upward-facing cups 66. The packer segments, as in packer 20, may be made of asbestos fiber impregnated with an intermediate hard thermoplastic such as Teflon, interwoven with Inconel wire, the desired segment shape being formed as previously disclosed. Center packer ring 72 is of a substantially triangular cross-section, having side faces 74 and 76 at convergently radially inclined equal angles to the radial extent of the packer ring. Between center packer ring 72 and upper cuts 64 are a plurality of substantially identical downward-facing frustconical packer rings 68. Similarly, between packer ring 72 and lower cups 66 are located a plurality of upward-facing frustoconical packer rings 70. Rings 68 and 70 are of substantially the same outer diameter in their uncompressed state as cups 64 and 66, and rings 68 and 70 all have substantially parallel radially inclined side faces. The initial angle of radial inclination of the side faces of packer rings 68 and 70 is greater than that of side faces 74 and 76 of center packer ring 72. The packer element thus comprises packer segments 68, 70 and 72.

Below and abutting lower sliding shoe 258, and surrounding packer mandrel 30, are a plurality of belleville springs 78. Below belleville springs 78 is lower anchor shoe 280, having radially flat upper face 282. Lower anchor shoe 80 overlaps and surrounds latch nipple 86 at 283. Latch nipple 283 possesses an inner diameter substantially greater than the outer radial extent of ratchet teeth 40, which it envelops. At the lower axial extent of latch nipple 86 is located downwardly radially divergent face 90. Latch nipple 86 is threaded to annular piston 300 at 302. Latch nipple 86 and hence annular piston 300 are fixed in place while packer 220 is run into the well by a plurality of shear pins 284, which extend into reduced diameter area 38 on mandrel 30. Annular piston 300 possesses an undercut at 303. An annular cavity of substantially triangular cross-section is created by undercut 303, radially divergent face 90 of latch nipple 86, and ratchet teeth 40. In the aforesaid annular cavity is disposed latching dog 98, which comprises a plurality of arcuate segments. The inner edge of these arcuate segments possesses downward-facing ratchet teeth 100 which mate with upward-facing ratchet teeth 40 on packer mandrel 30. The forward faces 102 of the segments of latching dog 98 are radially inclined at substantially the same angle as radially divergent face 90 of latch nipple 86. The segments of latching dog 98 are held against ratchet teeth 40 of packer mandrel 30 by O-ring 104. The lower face (unnumbered) of latching dog 98 is radially flat.

Annular piston 300 is slidably disposed about packer mandrel 30. A plurality of pressure relief ports 304 extend from the inner surface of the forward portion of annular piston 300 to the outer surface, which is on the outside of packer 220. Similarly, a plurality of pressure relief ports 308 extend from the inner surface to the outer surface of piston 300 near its lower end. The trailing portion 309 of piston 300 is of greater wall thickness and smaller inner and outer diameter than the forward extent thereof, riding in sealing engagement with surface 42 of packer mandrel 30 and also with outer sleeve 138, which surrounds piston 300 throughout a portion of the piston's axial extent. A seal is effected with packer mandrel 30 by O-ring and back-up seals 132, and with outer sleeve 138 by O-ring and back-up seals 134. The trailing surface 310 of piston 300 is radially flat.

Fluid passage 136 extends between an annular chamber defined by trailing surface 310, the inner surface 140 of outer sleeve 138, packer mandrel 30, the leading surface of nipple 48, and packer actuation port 34.

A seal is effected between nipple 48 and outer sleeve 138 by O-ring and back-up seals 144, outer sleeve 138 being fixed to nipple 48 by set screws 142.

In operation, packer 220 is run into the well casing 10 as a part of liner assembly 212, which is secured in place. An isolation gravel packer is placed across ports 34 and tubing pressure is applied therethrough against trailing surface 310 of annular piston 300. As annular piston 300 moves axially upward, latch nipple 86 is forced in the same direction, and shear pins 284 are sheared. Lower anchor shoe 280 then acts upon belleville springs 78, compressing them fully. After springs 78 are compressed, the continued upward movement of lower anchor shoe 280 shears shear pins 262, releasing lower sliding shoe 258, which in turn moves upward, compressing packer segments 68, 70 and 72 against upper anchor shoe 52, forcing the packer element outward against the wall of casing 10.

The movement of annular piston 300 and latch nipple 86 in an axially upward direction carries latching dogs 98 in the same direction, due to the contact of latching dogs 98 with the radially flat surface immediately below undercut 302 on annular piston 300. The downward facing ratchet teeth 100 on latching dogs 98 ride over the upward-facing ratchet teeth 40 on packer mandrel 30 with minimal resistance.

At this point, packer segments 68, 70 and 72 are compressed, as are belleville springs 78. When tubing pressure is released, latch nipple 86 will tend to ride back down to its initial position due principally to the force exerted by the compressed belleville springs 78. This downward movement will be halted after a very brief travel by the contact of radially divergent face 90 with the forward faces 102 of latching dogs 98, which will force dogs 98 radially inward, locking them against mandrel 30 by the interaction of ratchet teeth 100 with ratchet teeth 40. Thus, packer 220 is locked in a set position without the continued maintenance of tubing pressure, and packer segments 68, 70 and 72, which are of non-elastomeric materials, are maintained in compression by the continued force of compressed belleville springs 78.

From the above disclosure, it is evident that applicant has invented a novel and unobvious packer design. The numerous advantages of the desired embodiments of the packer design over the prior art include, but are not limited to, the absence of any valve mechanism, mechanical maintenance of the packer in its set position, and the use of spring elements to maintain non-elastomeric packer segments in a compressed state. Various additions, deletions and modifications to the disclosed embodiments are apparent to one skilled in the art without departing from or exceeding the scope of the invention. For example and not by way of limitation, a packer element in a different configuration might be employed; the belleville springs might be placed above the packer element, or several on each side; springs other than belleville springs might be employed; the piston and latching dog assembly might be placed above the packer element. These and many other modifications fall within the spirit and scope of applicant's invention, as defined in the following claims.

I claim:

1. A packer, comprising: mandrel means;

a compressible packer element on said mandrel means;

fluid pressure actuated piston means adapted to compress said packer element; and mechanical packer element compression maintenance means, including:

ratchet means associated with said piston means; and spring means adapted to exert an axial force on said packer element and said ratchet means.

2. The packer of claim 1, wherein said piston means comprises annular piston means.

3. The packer of claim 2, wherein said packer further includes fixed anchor shoe means at one longitudinal extent of said packer element, and sliding shoe means at the other longitudinal extent of said packer element, said annular piston means adapted to act upon said sliding shoe means.

4. The packer of claim 1 wherein said spring means comprises at least one belleville spring.

5. The packer of claim 1 wherein said ratchet means further comprises cooperating first and second ratchets associated with said packer compression means and said mandrel means.

6. The packer of claim 5, wherein said first and second ratchets are adapted to permit movement of said piston means in one axial direction, and prohibit axial movement in the opposite direction.

7. The packer of claim 1 wherein said piston means comprises annular piston means adapted to axially compress said packer element when acted upon by fluid pressure, and said ratchet means comprises latching dog means having downward-facing ratchet teeth and cooperating upward-facing ratchet teeth on said mandrel means, said latching dog means being movable in conjunction with said annular piston means during packer element compression, and being restrained from movement in the opposite direction through engagement of said latching dog ratchet teeth with said mandrel means ratchet teeth.

8. The packer of claim 7, wherein said latching dog means possesses a radially divergent downwardly inclined face adapted to cooperate with a substantially parallel face on said annular piston means, whereby said latching dog means is forced against said mandrel ratchet teeth as said annular piston means is moved in a downward direction.

9. The packer of claim 1 further including shear pin means adapted to maintain said packer in an unset mode until a predetermined fluid pressure is applied to said packer element compression means.

10. The packer of claim 9 further comprising shoe means associated with said packer element means, said shear pin means fixing said shoe means to said mandrel means.

11. The packer of claim 9, wherein said shear pin means fix said packer element compression means to said mandrel means.

12. The packer of claim 1, wherein said piston means comprises an annular piston, an associated annular ball housing, at least a portion of which is surrounded by said annular piston, and at least one ball constrained in an aperture of said ball housing, said ball adapted to maintain said ball housing in fixed relationship to said mandrel means until said shear pin means is sheared.

13. The packer of claim 12, wherein said shear pin means fixes said ball housing to said annular piston, said ball is of greater diameter than the wall thickness of said ball housing, said mandrel means possesses an annular groove on the exterior thereof into which a portion of said at least one ball protrudes prior to the shearing of said shear pin means, and said annular piston possesses an annular groove on the interior thereof.

14. The packer of claim 13, wherein said annular piston shears said shear pin means when acted upon by said predetermined annular pressure, whereby said annular piston groove is radially aligned with said at least one ball, said ball being permitted to move radially outward and thereby releasing said ball housing from said mandrel means, said packer element then being compressed by said piston means.

15. A high-temperature well bore packer comprising:

a tubular mandrel;

a non-elastomeric packer element on said mandrel;

an annular piston adapted to move axially in response to fluid pressure;

belleville springs adapted to be compressed against said packer element by axial movement of said annular piston; and cooperating ratchet means associated with said mandrel and said annular piston and adapted to permit axial movement of said annular pistion in a first direction and to preclude axial movement in a second, opposite direction.

16. The high temperature packer of claim 15, wherein said ratchet means comprises latching dogs associated with said annular piston, and ratchet teeth on said mandrel.

17. The high temperature packer of claim 16, wherein said latching dogs possess downwardly inclined radially divergent faces which cooperate with a substantially parallel annular face associated with said annular piston, whereby said latching dogs are forced into engagement with said mandrel ratchet teeth if said annular piston moves in a downward direction.

18. The high temperature packer of claim 17, further including shear pin means adapted to maintain said packer in an unset mode until said annular piston is subjected to a predetermined level of fluid pressure.

* * * * *